United States Patent [19]

Krubsack et al.

[11] Patent Number: 5,021,760

[45] Date of Patent: Jun. 4, 1991

[54] SOLENOID SWITCH CONTACT AND MOUNTING ASSEMBLY

[75] Inventors: Larry J. Krubsack, Colgate; Allen L. Handy, North Prairie; John G. Lawton, Milwaukee, all of Wis.

[73] Assignee: Clum Manufacturing Company, Inc., Hartland, Wis.

[21] Appl. No.: 415,912

[22] Filed: Oct. 3, 1989

[51] Int. Cl.[5] ..... H01H 1/12; H01F 15/10

[52] U.S. Cl. ..... 335/196; 336/192

[58] Field of Search ..... 335/131, 126, 193, 97, 335/196; 336/192

[56] References Cited

U.S. PATENT DOCUMENTS

| | | | |
|---|---|---|---|
| 2,540,185 | 2/1951 | Brown | 200/111 |
| 2,782,282 | 2/1957 | Schrack | 200/111 |
| 3,238,329 | 3/1966 | Russo . | |
| 3,260,824 | 7/1966 | Schleicher | 200/104 |
| 3,272,949 | 9/1966 | Lawrence | 200/166 |
| 3,597,562 | 8/1971 | Turnbull | 200/166 BC |
| 3,689,856 | 9/1972 | Lambert et al. | 335/133 |
| 3,731,245 | 5/1973 | Roslin | 336/192 |
| 3,848,206 | 11/1974 | Prouty et al. | 335/193 |
| 3,848,206 | 11/1974 | Prouty et al. | 335/193 |
| 4,029,916 | 6/1977 | Chu | 200/5 A |
| 4,052,580 | 10/1977 | Stanish | 200/159 R |
| 4,086,553 | 4/1978 | Robandt et al. | 336/192 |
| 4,166,265 | 8/1979 | Reynolds et al. | 336/192 |
| 4,382,242 | 5/1983 | Colvin et al. | 335/202 |
| 4,446,449 | 5/1984 | Brown | 335/131 |
| 4,521,758 | 6/1985 | Krubsack | 335/131 |
| 4,604,597 | 8/1986 | Bögner et al. | 335/131 |
| 4,634,819 | 1/1987 | Ikeda | 200/16 A |
| 4,706,037 | 11/1987 | Prouty et al. | 335/193 |
| 4,755,781 | 7/1988 | Bögner et al. | 335/131 |
| 4,801,909 | 1/1989 | Fasola | 335/126 |
| 4,862,123 | 8/1989 | Gray et al. | 335/131 |

*Primary Examiner*—Steven L. Stephan
*Assistant Examiner*—Nilay H. Vyas
*Attorney, Agent, or Firm*—Andrus, Sceales, Starke & Sawall

[57] ABSTRACT

A solenoid starter switch unit for garden tractors, outboard motors and the like operating in a vibrational environmental has an insulating housing with a coil chamber and an outwardly extending rectangular contact chamber. A coil unit supported in the coil chamber has a magnetic plunger with a contact pin journalled in one end and projecting into the contact chamber. The pin has an intermediate contact ledge and a contact has a flat base abutting the contact ledge. The contact is a winged-shaped strip of constant width substantially corresponding to the ledge and is symmetrically formed with a flat base on an inclined portion connected to an outer flat contact portion parallel to the base. An outer lip projects laterally and inwardly from the contact portion. A clamp nut on the pin has an outer edge engaging an outer portion of the base. Coil leads in one embodiment project through the top housing wall. Terminals are press fitted within receptacles on the top of the bobbin. The coil leads pass through top openings in the bottom and are wound about the terminals and soldered in place. The coil leads in another embodiment extend from the bottom of the bobbin and laterally through recessed guides to a bottom terminal chamber. A bottom coil clamp has a projection between the guides to hold the bottom against rotation and clamp the coil within the housing.

14 Claims, 3 Drawing Sheets

FIG. 9
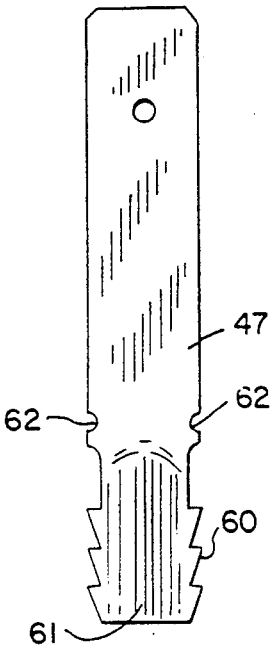
FIG. 10
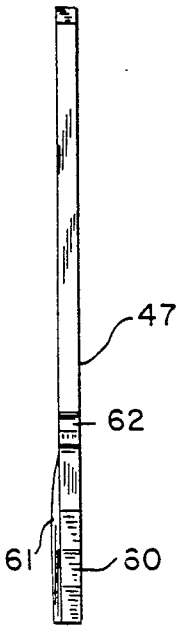
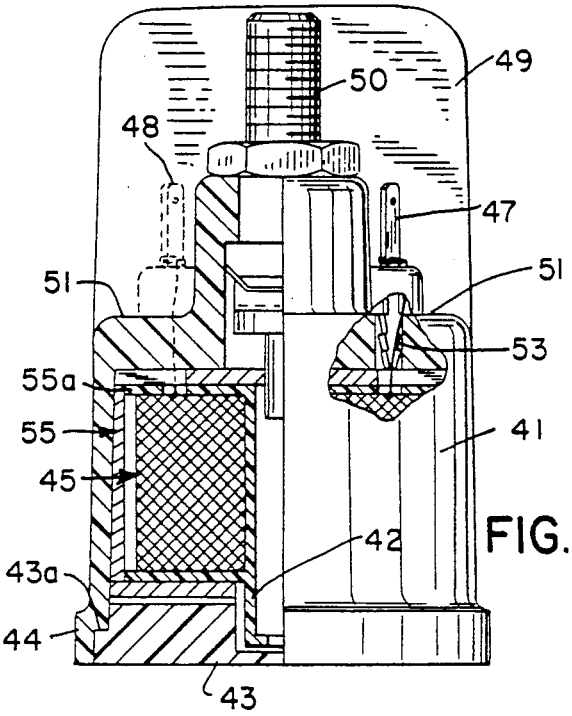
FIG. 6
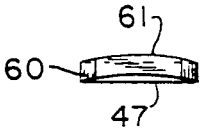
FIG. 11
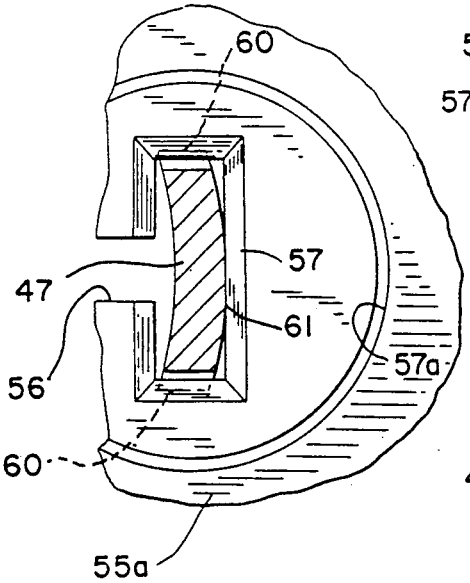
FIG. 8
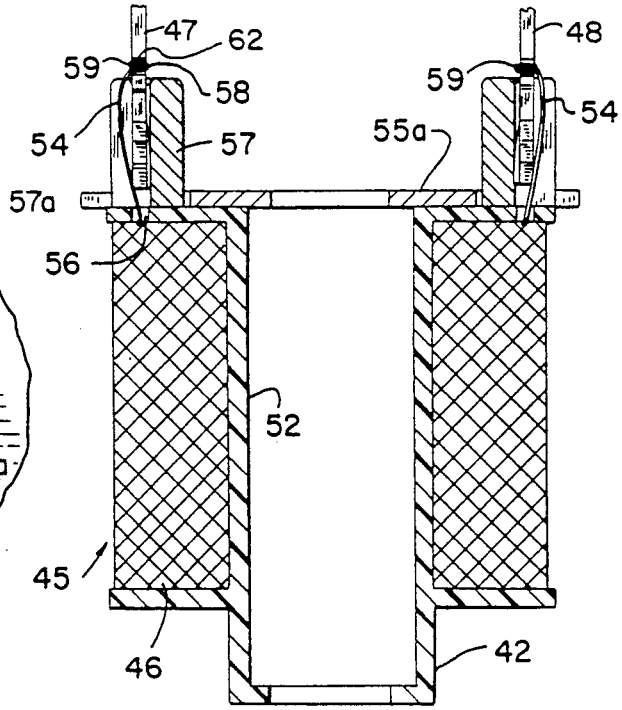
FIG. 7

SOLENOID SWITCH CONTACT AND MOUNTING ASSEMBLY

BACKGROUND OF THE PRESENT INVENTION

The present invention relates to a solenoid switch contact and mounting assembly, and particularly to such a switch contact and assembly for solenoid starter switches and the like which operate in severe environments.

Solenoid operated switches are widely used to supply power to a load device in response to a relatively low level control current supplied to the solenoid. Electric starters for various over-the-road and off-road vehicles including conventional automobiles, trucks, lawn tractors, larger lawn mowers and the like are generally provided with electric starters for ease and convenience of starting the vehicle. A solenoid switch unit is provided and includes a solenoid coil connected in circuit to the battery through a start control switch to establish a low current circuit. The contacts of the solenoid switch unit are connected in series with the battery and the starter in a relatively high current and power circuit to provide the power required for operation of the starter. A particularly satisfactory starter switch unit is disclosed in U.S. Pat. No. 4,521,758 which issued to L. J. Krubsack, on June 4, 1985 and is entitled "Electric Solenoid Structure". As disclosed in such patent, an insulating housing is provided with a specially formed chamber for receiving a solenoid coil. A plunger mounted contact assembly is coupled to the coil and extends outwardly therefrom into a specially formed rectangularly shaped contact chamber or section of the housing. A pair of contact bolts are secured in the outer wall of the chamber with a relatively large flat contact head structure exposed in the outer end of the switch chamber. A spring-loaded and flat contact member is resiliently mounted on a pin. The pin and contact move within the rectangular chamber into and from engagement with the contact heads of the contact bolts for opening and closing the main power circuit.

The vehicles in which the starter unit is mounted create a rather severe operating environment, including in many instances significant vibrational movements. Rapid and effective opening and closing of the bridging contacts is significant to prevent destructive arcing between the fixed contact and the movable contacts. Under even optimum conditions however, the contacts are subject to significant wear and inherently some arcing will occur. The result is a reduction in the life of unit.

Various prior art devices in connection with solenoids have provided relatively complex supporting structures particularly for use in environments where contact bounce is considered a problem and undesirable. For example U.S. Pat. No. 3,848,206 which issued Nov. 12, 1974 and is entitled "Electromagnetic Solenoid with Improved Contact Antibalance Means" discloses a contact journalled on a supporting pin and movably mounted thereon. A backing support is provided on the pin with outwardly projecting arms which move outwardly into backing relation to the outer contact portions. The total assembly remains in its fixed relationship in moving between open and closed position with the relatively rigid contact moving downwardly on the plunger or pin and deflecting the backing spring member. A sliding contact assembly is also illustrated in U.S. Pat. No. 4,634,819 which issued Jan. 6, 1987 and is entitled "Movable Contact Assembly for a Switch". Again the central portion of the contact is mounted with a spring loading support with a spring retainer located between the sloping guide surfaces. Earlier patents such as U.S. Pat. No. 2,782,282 which issued Feb. 19, 1957 and is entitled "Pneumatically Operable Switch" discloses an operable switch unit having a contact member located in a supporting block 6 which is formed of a resilient material a such as rubber, felt or the like to again provide a resilient support for the central portion of the contact. In other electromagnetic relay structures relatively rigid contact members are provided and spring loaded for resilient engagement with the fixed contacts. One such structure is shown in U.S. Pat. No. 3,272,949 which issued Sept. 13, 1966 and is entitled "Bifurcated Parallel Contacts for Relay". Although such contacts are widely used and although many different contact assemblies are disclosed in the prior art, there is a need for a longer life and effective contact assembly particularly adapted for use in solenoid starter assemblies such as disclosed in U.S. Pat. No. 4,521,758.

Other patents show various deflecting spring members with contact elements on the outer ends thereof to form a bridging contact. Such members are usually specially shaped with various curved configurations to effect a wiping action in connection with opening and closing of the contacts. The curved configuration is desirable to provide the desired action in opening and closing. The curved members are formed of special conductive resilient metals and repeatable corresponding precise shaping of metal blanks is difficult. Consequently, the production of like wing contact structures in mass production of solenoid starters, with corresponding reliable and effective action, requires special and costly production techniques. Generally, a relatively wide variation in the action of the solenoid starters is often accepted to obtain the benefits for economic mass production.

There is therefore a need and demand for an improved solenoid switch starter assembly which further minimizes arcing and wear of the contacts.

SUMMARY OF THE PRESENT INVENTION

The present invention is particularly directed to an improved contact assembly forming an integrated part of a solenoid operated switch unit, and to such a contact assembly which significantly increases the contact life and thereby the operational life of the switch unit, as well as to an improved coil assembly and coil connecting assembly. Generally in accordance with a teaching of the present invention, the contact is formed as an integral wing-shaped contact having a base portion fixedly secured to a resiliently loaded plunger, and with the outer contact portion specially form to provide an extended planar contact area. The specially shaped and mounted contact is formed as an integral single piece member of a resilient and highly electrically conductive metal. In operation, the contact moves rapidly between its two positions, and in so moving provides an appropriate contact interface. The wing-shaped contact moves with a wiping action over the rigid surface of the fixed contacts to produce optimum opening and closing. Arcing is essentially eliminated and the contact assembly has an exceedingly high cycle rate and life, thereby establishing and producing a long life for the switch unit.

More particularly and in accordance with this teaching of the present invention, the contact assembly forms a part of the integrated solenoid unit which is formed with the rectangular contact guiding chamber to guide the contact into and from closing engagement with the fixed contacts. The contact is formed with a central flat mounting base portion having a central opening for mounting to a plunger. The contact is formed symmetrically about the center of the contact. Each wing side is similarly formed and includes a flat connecting portion projecting outwardly from the mounting base at a sharp angle to the plane of the base. A small flat contact land extends from the connecting portion and is essentially parallel to the mounting base and spaced to lie generally centrally of the fixed contact in the closed switch position. In the unstressed open position, the flat contact land is located adjacent to the inner edge portion of the fixed contact. The outer edge of the wing-shaped contact extends at a reverse angle from the contact land within the guide chamber, with the outer edge spaced from the adjacent wall of the guide chamber to permit free movement of the contact.

In one preferred construction, the mounting base portion has a length which constitutes about one third the length of the contact and is mounted to a pin having a diameter equal to one half the width of the contact. Clamping members fixedly secure and clamp the base to the pin with a firm rigid type interconnection. This limits the flexure of the contact with the wing portion projecting from the base and in essence prevents flexure in the base adjacent the pin opening. The structure thus limits the flexure to the area of maximum width of the contact and contributes to a long operating life.

An alternate embodiment of the present invention includes construction with the coil terminals located in circumferentially spaced relation to the contact terminals within the outer end of the solenoid unit. The alternate construction is particularly adapted for mounting of the solenoid to a base support with the power connection and the contact connection made to the outer end of the solenoid and spaced from the support structure. The coil unit is formed with the bobbin wall including a terminal chamber projecting outwardly of the wall. The terminal is press filled into the chamber and preferably includes barbs which project into the chamber walls. The coil wire is wound about the terminal, which preferably has edge recesses for receiving the lead wire. The wire is soldered to the in-place terminal. The heating tends to heat the plastic chamber walls and more firmly embeds the terminal barbs into the chamber walls to firmly support the terminal as well as establishing a firm electrical connection. The assembled coil unit with the terminals in place 6 inserted into the housing with the terminals passing through openings in the housing end walls in spaced relation to the inner contacts and the contact terminals.

In certain applications, a bottom connector assembly is specified and required. Further, compact and limited spaced requirements dictate that a small compact coil unit be provided. In accordance with a further aspect of this invention, the coil lead connector is formed with a pair of outwardly projected connector members integrally formed or affixed to the bottom wall of a coil bobbin. The coil leads are extended through an opening in the wall and the connector, with an offset recess permitting the direction of the lead outwardly of the coil chamber. The connector member projects laterally into a bottom terminal chamber. The outer end of the recess is slightly enlarged and flared to permit the lead to be moved and curved from the connector into overlying engagement with a terminal for firm interconnection thereto and with minimal stress in the thin lead wire. A bottom clamp plate is secured abutting the lower end of the bobbin and is shaped to mate with and interlock with the lead connector members thereby positively and firmly clamping of the bobbin coil against movement within the chamber and providing firm, reliable support for the lead connectors. A suitable sealant can be provided between the clamp plate and a bottom cover to essentially seal the lead connection and chamber against entry of moisture and the like. A sealed chamber is particularly desirable where the coil chamber and an electronic control chamber are formed as an integrated assembly with the coil connected through a common wall between the coil chamber and an electronic chamber.

The inventors have found that starter solenoids for various environments such as lawn tractors, outboard motors and the like, particularly of the smaller size where they often have very confined enclosures, are desirably specially wound with H insulation wire. Although such heavy insulated wire is readily available, such wire has not been used in the solenoid starters to the inventors' knowledge. One of the difficulties of course is that the space requirements have normally been such that a more conventional wire is employed to permit the construction of a small compact assembly. The inventors discovered however that by using of the high temperature H insulation wire, the other components can be readily modified to accommodate and reduce the overall size of the unit without affecting the overall operation and result.

The inventors have further found that the vertical heighth of the starter unit may be reduced by using minimum length output terminals and by reducing the thickness and thereby the height of the top wall of the housing.

The present invention has been found to operate reliably and effectively in high vibrational environments such as encountered in starters for vehicles including lawn tractors, outboard motors and the like.

BRIEF DESCRIPTION OF THE DRAWINGS

In the Drawing:

FIG. 1 is an elevational view of a solenoid starter for a vehicle or the like;

FIG. 6 is a side elevational view of an alternate embodiment of the invention with parts broken away and sectioned to show inner detail of the structure;

FIG. 7 is a similar elevational view of the coil unit and interconnecting coil terminals removed from the solenoid unit shown in FIG. 6;

FIG. 8 is a fragmentary plan view of a portion of FIG. 7;

FIG. 9 is an elevational view of a coil terminal shown in FIGS. 6–8;

FIG. 10 is a side elevational view of FIG. 9;

FIG. 11 is a bottom view of FIG. 9;

DESCRIPTION OF THE ILLUSTRATED EMBODIMENT

The invention is shown in a solenoid switch unit 1 of a construction generally corresponding to the construction more fully disclosed in the previously identified U.S. Pat. No. 4,521,758.

Figure 1:
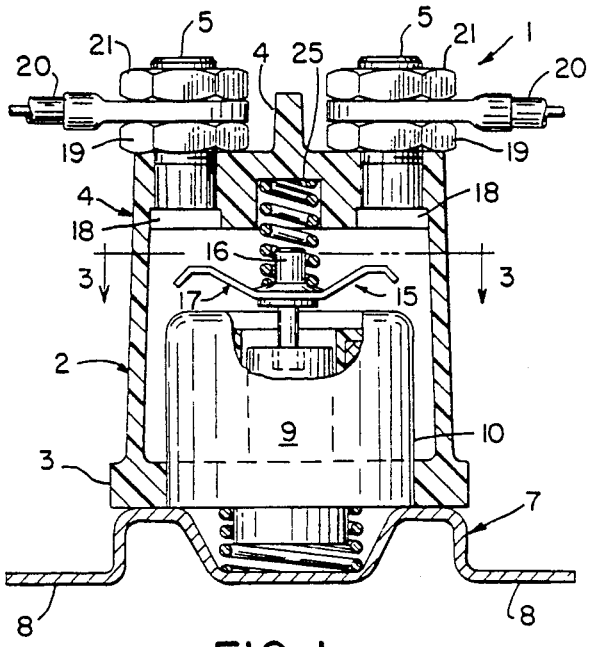
Figure 2:
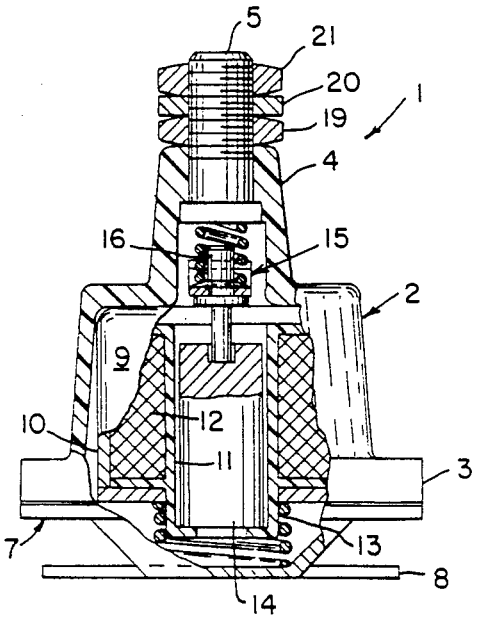
FIG. 2 is an enlarge vertical section through the starter shown in FIG. 1.
Figure 3:
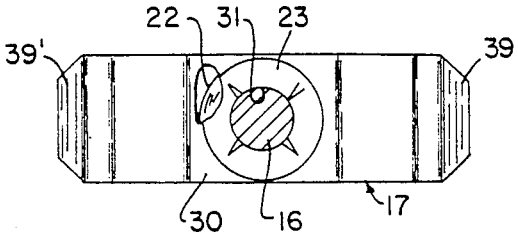
FIG. 3 is an exploded pictorial view of a switch contact assembly shown in FIG. 2.

Referring to the drawings and particularly to FIGS. 1 and 2 a solenoid switch unit 1 is illustrated including an outer plastic housing and generally adapted for use in engine starter circuits. The housing is formed with a hexagonal coil section 2 integrally formed to a mounting base or flange 3 on one end and an outwardly projecting rectangular contact section 4 to the opposite, or upper end, in the drawings. A pair of fixed power terminals 5, which can be any thread size and length, or other suitable electrical connecting device, are secured to the upper end wall of the contact housing section 4. A coil terminal 6, which can be any thread size and length or other electrical connecting device, is located on the mounting flange 3. The solenoid housing 2 is formed with an open bottom at the flange 3, which is closed by a metal mounting plate 7 having outwardly projecting mounting ears 8. The mounting plate may be connected to form the ground connection of an annular coil unit 9 mounted within the coil section 2. The coil unit 9 is an annular assembly including an outer cup-shaped can 10 formed of a suitable magnetic flux carrying material such as a conventional steel. A suitable insulating bobbin 11, having a center tube and opposite end flanges defines an annular recess within which a winding 12 is wound The central tube includes an integral outward projection 13 which projects outwardly of the casing or can 10 and defines an elongated chamber within which cylindrical armature 14 is slidably disposed. The armature 14, in the form of a solid plunger or cylinder, is slidably mounted within the coil unit 9 for movement to a lower position and moving in response to energization of the coil unit 9. A bridging contact unit or assembly 15 is located within the upper contact section 4 and includes a pin 16 coupled to the armature 14 for vertical movement of the contact assembly. The fixed terminals 5 are exposed within the housing section 4 for selective engagement by the outwardly or upwardly moving bridging contact unit 15.

The contact housing section 4 has an internal rectangular cross section with the longer length of which is aligned with the power terminals 5 and the contact unit 15.

The power terminals 5 are relatively heavy highly conductive copper bolts. The inner head 18 of each bolt terminal 5 is generally a rectangular portion with an outer geometric shaped edge which mates with a corresponding recess in the outer end wall of the rectangular section 4. The inner face of head 18 is a flat, smooth contact surface. The bolt terminal 5 is pressed in place and projects outwardly with a suitable clamping nut 19 for fixed mounting of the terminal in place. A power lead 20 is connected to the terminal by an outer connecting nut 21.

The present invention is particularly directed to the contact unit 15 which provide a rugged and reliable assembly and which can be constructed at a reasonable cost and provides an extended contact life.

The contact assembly 15 in the preferred embodiment includes a single element and winged bridging contact 17 formed of a highly conductive material. The bridging contact 17 is secured to a pin 16 for selective positioning with respect to the fixed power terminals 5.

The contact assembly 15 includes the rectangular bridging contact 17 slidably disposed on the pin 16. The pin 16 may be formed of suitable plastic, a machined non-magnetic metal or the like. The pin 16 includes an enlarged central clamping ledge or flange 22 shown as an integral part of pin 16. The contact 17 is located on the pin 16 resting on flange 22. A clamped nut 23 is press fitted or otherwise secured to the pin 16 to fixedly attach the contact to the pin 16. The pin 16 extends from such flange and securement and projects through the opening in the magnetic can 10 and into the solenoid armature 14. The pin includes a spring guide portion extending from flange 22 in the opposite direction toward the end wall 25. A bias stabilizing spring 24 is located between the outer end of the pin 16 and the end wall 25 of the housing section 4 and resiliently urges the contact assembly 15 into engagement with the armature 14. The force of the spring 24 is sufficiently great to stabilize the location of the contact assembly.

The winged-shaped contact 17 is specially and preferably formed as a single metal element having a limited degree of flexibility. The contact 17 includes the central base 30 affixed to the support pin 16. The contact 17 and particularly the base 30 has a width about twice the diameter of the pin 16 and terminates in inwardly spaced relation to the fixed contacts 5. The center of the base 30 includes an opening 31 substantially corresponding to the diameter of the contact pin 16. The pin 16 is formed with the circular clamping ledge or flange 22 as integral member, against which the contact rests. The flange 22 is shown as a round element having a diameter essentially the same as the width of the base 30. The clamping nut 23 may be a Timmermann clip unit pressed over the pin and into abutting engagement with the outer face of the contact base, and thereby firmly affix and clamp the contact base 30 to the clamping flange 22. The clamping nut 23 has a diameter slightly less than that of the clamping flange 22 such that the base 30 is firmly affixed to the pin 16 with the outer portion of the base on the flange forming a rigid support of the wing contact 17 over a large area of the base.

The pin 16 may be formed of a suitable plastic, machined brass or the like. The pin is preferably formed with the integral clamping ledge or flange 22. The spring guide portion of the pin 16 is slightly larger than the portion projecting downwardly into the solenoid armature 14. The preload coil spring 24 projects over the guide portion and acts between the clamping nut 23 and the upper end of the housing to resiliently load the plunger, generally as shown in the prior identified U.S. Pat. No. 4,521,758.

The wing-shaped contact 17 is symmetrically formed and is provided with oppositely located wingshaped portions 33 and 34 which extend outwardly in opposite directions to contact lands 35 and 35' which are aligned with the fixed bolt terminal contacts 5.

Figure 5:
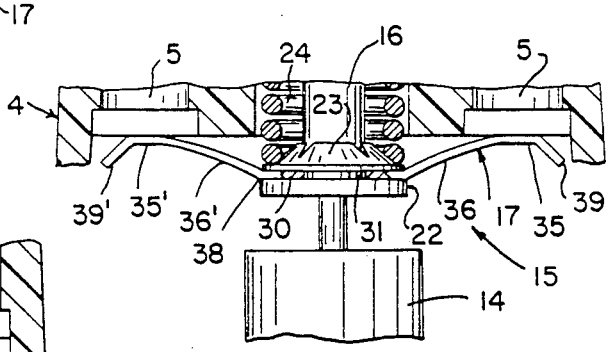
FIG. 5 is a view similar to FIG. 4 illustrating the closed position in full line illustration.
Figure 4:
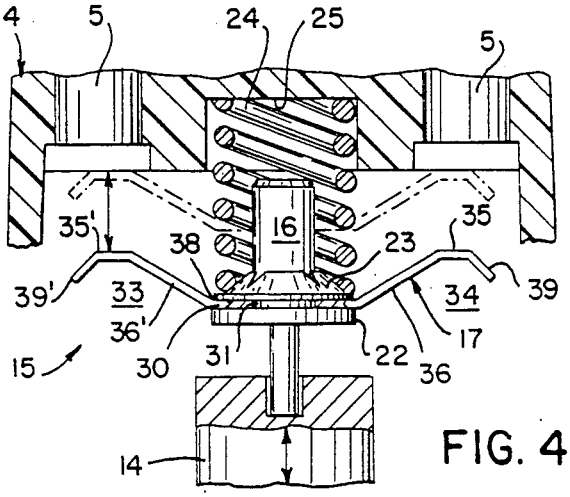
FIG. 4 is a view illustrating the contact assembly and fixed contacts in a open position in full line and in the closed position in phantom.

Referring particularly to the contact portion shown to the right side of FIGS. 4 and 5 is described in detal.

An integral inclined connection portion 36 extends from the base 30 outwardly and laterally toward the fixed contact 5. The connecting portion 36 is a flat member which is shown extended substantially at 45°. The contact land 35 is integrally formed with the outer end of the inclined connection portion 36 and is located parallel to the plane of the flat face of the fixed contact 5. The inclination of the connecting portion 36 is such that in the contact open position the flat contact land 35 is generally aligned with the laterally inner edge portion of the fixed contact 5, as shown in FIG. 4. As the contact assembly 15 moves outwardly, the contact land moves into closing engagement with the fixed contact 5, with the connecting portion 36 deflecting inwardly about the base connection 38, as shown in FIG. 5. The contact land 35 wipes across the fixed contact 5 maintaining the parallel relationship to provide a sliding contact action during the opening and closing of the contacts. The wiper may be coated with a suitable conductive material for the particular aplication. The rubbing action serves a cleaning function on the surfaces. A reverse action occurs during the opening to provide an improved contact closing and opening. This minimizes arcing, contributes to an extended contact life, and to surface cleaning.

The outermost edge of the wing-shaped contact includes a rearwardly inclined lip 39 integrally formed to the outer edge of the flat contact land.

The opposite contact side of the wing-shaped contact is identically formed with the inclined connection 36' to land 35'.

The single integral contact element 17 is formed of a suitable high conductivity and resilient metal. A particularly satisfactory contact material for contact 17 in solenoid starters applied to lawn tractors, outboard motors and the like was a hard temper E.T.P. copper PEGG metals alloy No. 12102. In one application, a thin cadmium plating is applied over the contact surface side. In a practical application, the contact was 0.020 inches thick. The lands were 0.060 inches in length. The lands 35 were spaced equally to the opposite sides of the base 30 with a center-to-center length of 0.876 inches and with a base length of 0.40 inches. The contact width was about 0.360 inches. The described contact element is one typical example, and the size, contact material and the like may of course be varied as necessary or desired within the teaching of the present invention.

The resiliently mounted single contact element 17 is mounted with the contact assembly 15 unsupported other than by the resiliently mounted coil spring between the contact 17 and the housing 4. The contact 17 is particularly firmly affixed to the pin 16 to prevent relative movement within the base and restrict the flexure to the full width connection between the base and the connecting portion. The contact 17 is conveniently formed using known technology by cutting an appropriate strip from the sheet and bending of the cut strip into the desired configuration.

A significant feature of the wing shaped contact 17 is the fixed enlarged base 30 and the clamping of the base 30 to the flange 22 in radially spaced relation to the pin opening 31. This construction establishes a support for the base 30 to the connecting portion 36 and essentially prevents movement and particularly deflection of the base portion in the area of the pin opening 31 in base 30. The area immediately to the opposite lateral sides of the pin opening 31 is an area of minimal metal support. The prevention of any movement of the base in the area of the opening thereby prevents creation of the stress and fatigue in such minimum cross sectional support area, which otherwise is point of rapid failure.

The flexibility and resiliency of the single metal contact in combination with the special forming and location of the flexure point has been found to produce a highly effective and repeatable contact closing and opening under operating environmental conditions. The present invention which is particularly used in vehicles such as lawn tractors, outboard motors and the like operates in a highly vibrational environment. The provision of the specially formed and mounted contact with the positive opening and closing of the contact is particularly significant in that operating environment in minimizing undesired arcing.

The illustrated solenoid structure includes a mounting system generally in accordance as shown in U.S. Pat. No. 4,521,758. In certain other applications, other forms of mounting may be desired with the electrical connection made in spaced relation to the mounting structure. A solenoid with top or outer releasable contact and winding connections is illustrated in FIGS. 6 and 7.

Referring particularly to FIG. 6, a solenoid includes an outer housing 41 essentially corresponding to that of the above U.S. Pat. No. 4,521,758 and generally as illustrated in FIGS. 1-5. In the second embodiment, the lower end of the housing 41 projects downwardly below the plane of the bobbin extension 42. A closure plate 43 is secured within a recessed lower portion of the housing with the inner bottom wall **43*a* abutting the bobbin unit, generally as in the above U.S. patent. The bottom closure plate 43** is suitably secured within the housing and may be in a fluid tight relation to effectively close and seal the housing.

The lower end of the housing is shown with a small mounting lip 44 permitting mounting of the solenoid unit to any suitable support structure singly or as a plurality of assemblies.

The coil unit 45 is similar to that of the first embodiment with the winding 46 of the coil unit 45 connected to the power supply through terminals 47 and 48 projecting upwardly and outwardly of the housing. The upper end of the housing 41 includes the dividing wall 49 between the main contact terminal units 50 located centrally of the wall and to the opposite sides thereof the housing of contact units 45 are substantially smaller than the wall width and define a lands 51 to the opposite side thereof. The lands 51 are thus defined by the lower hexagonal housing portion and the upstanding wall 49 of the housing. The coil contacts or terminals 47, 48 are shown as rigid post contacts secured to the coil bobbin 52 and extended thrugh appropriate openings 53 in the land wall 51. In assembly, the bobbin 52 and terminals 47 and 48 are introduced into the housing 41 as an assembly with the integrated terminals 47 and 48 projecting outwardly through the land openings 53. The lands are enlarged in the area of the terminals to firmly support the terminals.

With the illustrated construction, the coil unit 45 includes an outer coil enclosure 55 similar to that disclosed in the original embodiment with the orientation of the coil leads 54 reversed to project outwardly through the intermediate portion and lands of the housing 41. The coil unit 45 is housed within an outer housing or enclosure 55 within the housing 41 as in U.S. Pat. No. 4,521,758. The enclosure 55 in the second embodiment includes a separate side wall, a bottom wall and a top wall 55*a* as also disclosed in the above patent.

In the illustrated embodiment, as shown most clearly in FIG. 7, the bobbin is formed with the coil leads 54 projecting outwardly the opposite sides of the bobbin and through a small edge opening 56. A terminal chamber 57 is formed on the upper wall of the coil bobbin. Chamber 57 projects upwardly through an edge recess 57*a* in the top enclosure wall 55. The terminal 47 is secured to the chamber 57 with the bobbin leads 54 wound about the respect terminal as at 58 and soldered thereto as by solder 59. In a unique and particularly effective connection, the bobbin is formed with the small or with outwardly located connector receptacles or chambers 57. The receptacles 57 are generally rectangular shaped, located centrally of the lead edge slot and adapted to accommodate the inner end of the connector or terminal 47. The outer edge of the receptacle is provided with a slot.

The terminal 47 is a flat strip-like member, the inner end of which is provided with serrated or tooth side edges 60. In addition, the inner end is deformed to form a curved cross-section, as shown at 61 in FIGS. 8-11. The terminal 51 is forced into the receptacle 57 and is mechanically secured in place by the interaction and gripping of the walls of the receptacle 51 with the serrated side edges 60 and the curved wall unit 61. The leads 54 extend outwardly about the edge of the bobbin and are wound about the spade connector immediately outwardly of the receptacle. The terminal 47 includes small edge recesses 62 shown as curved or moon-shaped recesses to receive the lead wire. The leads are then soldered to the connector as at 59. Soldering of the leads 54 to the terminal after travel through the terminal 47 and assembly to the bobbin receptacle 57 generates sufficient heat to slightly soften the receptacle walls thereby further contributing to the mechanical interconnection between the serrated terminal edges and the walls of the receptacle. The inventors have found that this provides for a very effective and reliable physical mounting of the terminal and electrical interconnection to the winding leads 54. This also provides reliable positioning of the terminals, contributing to the effective, rapid and ease of assembly with the housing as well as in cooperation with the openings in land walls of the housing providing a firm, reliable support for the terminals.

The alternate solenoid construction can thus be mounted with the exterior or outer end exposed for receiving a suitable electrical connector. The unit can of course be readily adapted to other forms of connectors such as screw-on connectors and the like.

The illustrated solenoid units with the top coil lead connectors provide a particularly advantageous sealed connection to the coil unit. Under certain applications, a bottom or base connector unit such as shown in the first embodiments may be desired or specified with the same other requirements as the top lead connections. In such applications, provision of a reliable interconnection of the coil unit to the terminals in environmental conditions, such as vibrations, moisture and the like often creates problems. The difficulties are related to the fact that the coil wire is of relatively thin wire typically often in the range of 26 to 32 gauge. Additional complications often arise in typical applications because of temperature conditions. Thus, operation of lawn tractors, outboard motors and the like generally occur in very warm environments. The starter coil units are often operated in a relatively extended continuous manner, particularly if there is any difficulty in starting of the engine, and the resistivity of the wire is such that heat is created which rapidly heats the coil unit. Finally, very limited space may be available for the mounting of the starter coil or the starter solenoid within the desired enclosure for the engine. The bottom connection of the coil units may thus be dictated by the space allotted to the solenoid unit.

Figure 12:
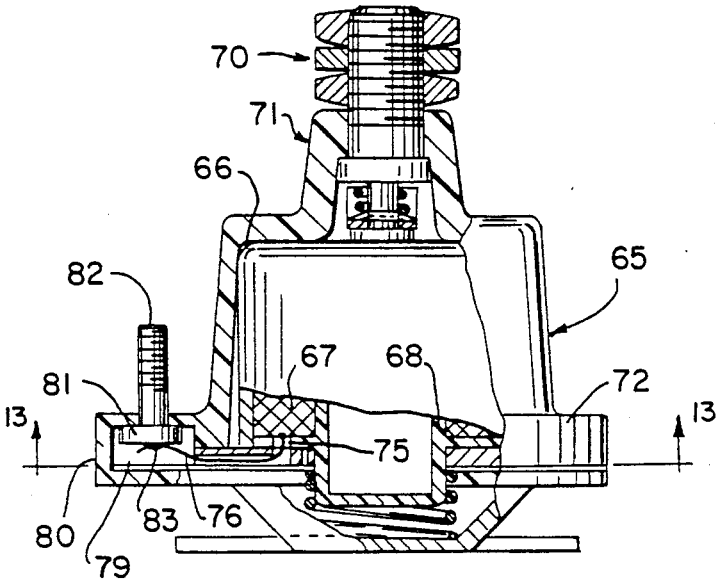
FIG. 12 is a view similar to FIGS. 2 and 6 illustrating a further embodiment of the present invention.
Figure 13:
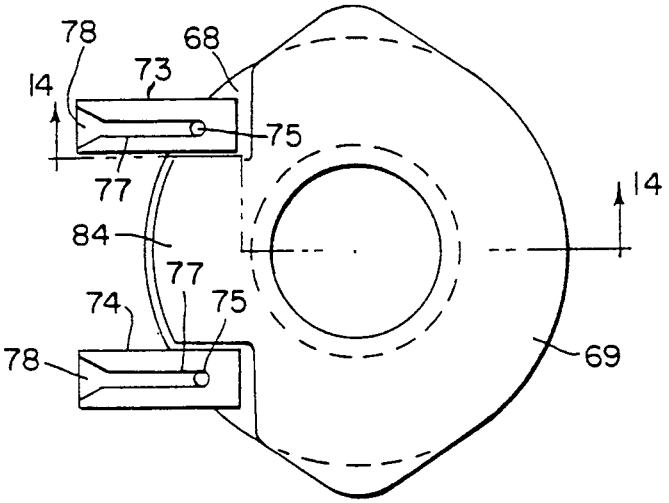
FIG. 13 is an enlarged sectional view taken generally on line 13—13 of FIG. 12.
Figure 14:
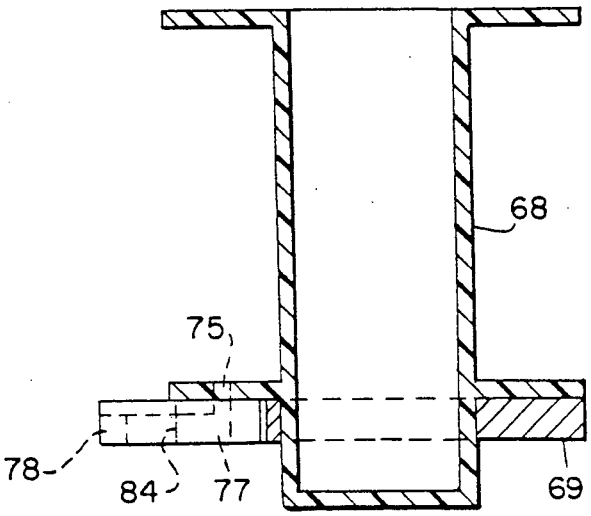
FIG. 14 is an enlarged fragmentary vertical section taken generally on line 14—14 of FIG. 13.

A small compact solenoid starter including an improved bottom or base coil lead connector assembly is shown in FIGS. 12-14 inclusive and more fully described as follows.

Referring particularly to FIG. 12, the solenoid starter unit 65 is illustrated with a portion of the housing broken away to illustrate the inner detail of construction. Generally, the inner chamber structure may and is illustrated essentially identical to that of the prior embodiments with a fixed coil chamber 66 within which a coil 67 is wound on a bobbin 68 and clamped in position by a bottom clamping unit 69. As more fully developed hereinafter, the bottom mounting unit in this embodiment however is uniquely and specially constructed to provide interconnection of the coil to the base mounted terminals. In addition, the power terminals 70 and the top wall structure 71 is of a reduced height to minimize the overall heighth of the solenoid starter unit 65.

As most clearly illustrated in FIG. 12, the bottom wall 72 of the coil bobbin 68 for confining of the coil 67 includes integral outwardly extended coil lead connector members 73 and 74. Each of the lead members 73 and 74 is similarly shown and constructed as integral rectangular member having an end telescoped and secured or integral with the bottom surface of the bottom wall 72. Each member 73 and 74 projects outwardly on a chordal line from the bottom wall. Referring to member 73, the member 73 and the bottom wall 72 includes an axial opening 75 in alignment with the coil 67. The opening 75 has a diameter permitting extension of the insulated coil wire 76 from the bobbin chamber. The outer surface of the integral connector member 73 includes a recess 77 projecting outwardly and longitudinally of the member from the opening 75. The outer end of the recess 77 flares outwardly as at 78 to define a generally enlarged and, on the illustrated embodiment, a conically shaped exit opening. The lead is projected within the recess and extends from the recess through the enlarged exit opening 78. The enlarged opening allows the lateral movement of the thin wire 76.

The lead members project outwardly, with the outer ends located with an offset or recessed portion 79 in the base 80 of the housing. The heads 81 of threaded terminals 82 are located within the recessed portion 79. The orientation of the members and the head structures are such that the members 73 and 74 terminate adjacent to and slightly spaced from the contact heads 81. The lead wire 76 can then move into the terminal head chamber and can be provided with a slight curvature to align and abut the outer end adjacent the respective head 81 to which it is firmly and securely soldered, as at 83.

As most clearly shown in FIG. 13, the outer clamping unit or member 69 is generally configured with a circular configuration having outwardly projecting ears on diametrically opposite edges with the projecting ears providing engagement with the housing wall as in the prior embodiment. However, in this instance, the one principal axis or curved portion of the clamping washer or member is cut away to accommodate the lead connector members 73 and 74. The cut-away portion thus defines a plate tongue member 84 which is located between the two lead connector members 73 and 74 and further serves to stablize and prevent rotation or movement of the bobbin and the interconnected leads 76. This has been found to provide a particularly stable and reliable support for the leads from the coil to the head connectors. The stability of the support contributes to minimizing any damage as a result of high frequency vibrations as encounter in various applications heretofore discussed.

In addition, the total unit with the clamping member 69 located in between the recessed lead connector members 73 and 74 defines a coplanar support. This permits effective sealing of the chambers and the lead connections against moisture, dirt and the like. Thus, a suitable gasket member can be interposed to seal the chamber including the lead connections and thereby contribute to the desired long operating life under severe operating conditions.

Various other applications for the bottom connection will be readily apparent to those involved in the art of solenoid and magnetic relay applications.

For example, in other applications, the solenoid housing may be integrally formed with an electronic circuit board chamber. The coil leads are extended through a common wall between the two chambers to provide a lead connection of the coil into the electronic circuit unit. Again, the fragile thin wires often employed require the same considerations as heretofore discussed. In addition, it may be desirable if not necessary to effectively seal the electronic chamber against entry of moisture. The present invention with the special lead connecting members integrally formed with the bobbin and forming a very minute passageway between the two chambers will permit effective and reliable sealing of the electronic chamber against moisture and the like.

The present invention provides a solenoid switch unit having a reliable switching contact apparatus which can be readily constructed with present day materials and technology. The coil unit is mounted with a stable and long life assembly.

Various modes of carrying out the invention are contemplated as being within the scope of the following claims particularly pointing out and distinctly claiming the subject matter which is regarded as the invention.

I claim:

1. A solenoid switch unit operating in a high vibrational environment, comprising an insulating housing having an inner coil chamber and an outwardly extending contact chamber projecting outwardly of the coil chamber, a coil unit disposed within said chamber and having a magnetic plunger axially mounted for movement toward and away from said contact chamber, a pin-like contact support journalled in said plunger and projecting outwardly into said contact chamber, said contact support having an integral contact ledge located intermediate the length of said support, a strip contact member having a central opening located over said pin abutting said contact ledge, said contact member being a generally winged shaped member and including a base abutting said ledge and with a center opening mating with said pin, said contact base having a width substantially greater than said support and extending outwardly from said center opening to the outer portion of the ledge, said contact member having connecting portions connected to said contact base and extending outwardly therefrom, a clamp member telescoped over said pin in abutting relation to said base and having an outer peripheral clamping portion having an outer diameter essentially corresponding to the width of said base and thereby fixedly clamping the outer portion of said base to said clamping ledge and restricting deflection of the contact member at the connection to said connecting portions, said contact member being symmetrically formed to the opposite sides of said pin opening and extending outwardly into sliding deflecting engagement with a fixed contact.

2. The solenoid switch unit of claim 1 wherein said each connecting portion include an inclined portion extending outwardly and laterally from said base and terminating in an outer flat contact portion, said contact portion extending outwardly from said connecting portion in substantially parallel relation to said base.

3. The solenoid switch unit of claim 1 wherein said contact member is formed of a hard tempered copper having an outer plating on the contact surface.

4. The solenoid switch unit of claim 2 wherein said each connecting portion is connected to said base and to said contact member by essentially lateral straight line bends in the contact member and defining essentially planar surfaces in said base, said connecting portion and said flat contact portion connected by essentially minimal radius connecting portions.

5. The unit of claim 2 having an outer lip portions projecting laterally and axially inwardly of said flat contact portion.

6. The switch unit of claim 1 wherein said insulating housing includes an enclosure wall secured to the open end of the housing, said enclosure wall engaging the coil bobbin and firmly clamping the coil unit within said housing, said housing having an intermediate located wall extending generally outwardly of the axis of the solenoid coil unit, said solenoid coil unit including at least one rigid terminal secured to the upper end of the coil unit, said rigid terminal projecting outwardly through an opening in said intermedial located wall, and having a releasable connector to receive an incoming complementing terminal.

7. The switch unit of claim 1 wherein said coil unit includes a bobbin structure with an inner insulating wall, inner insulating wall including a terminal receptacle, a terminal including an inner end located and press fitted within said receptacle, said terminal having a recessed portion immediately adjacent the receptacle, said coil unit including a winding with a connecting lead extending outwardly and wound about said recessed portion, and solder securing said lead to said terminal receptacle.

8. The switch unit of claim 7 wherein said terminal is pressed within said receptacle prior to soldering of said lead to said connector, and soldering of said lead to said connector to simultaneously heat the receptacle and thereby further establish a mechanical interconnection between said receptacle and said terminal.

9. The switch unit of claim 7 wherein said receptacle has first spaced parallel walls, said terminal hving edge members aligned with said first parallel walls and defining a width in excess of the spacing between said parallel walls whereby said edge members are forcibly engaged with said parallel walls and form a mechanical interconnection therebetween, said receptacle having second walls connecting said first spaced parallel walls, and said terminal having a curved cross-section abutting said one of said second walls.

10. A solenoid switch unit for an electric starter for a vehicle operating in a high vibrational environment such as !garden tractors, outboard motors and the like, comprising an insulating housing having an inner coil chamber and an outwardly extending contact chamber projecting outwardly of the coil chamber, a magnetic coil assembly including a coil unit disposed within said coil chamber and a magnetic plunger axially mounted for movement toward and away from said contact chamber, a contact support pin journalled in said plunger and projecting outwardly into said contact chamber, said pin having an integral contact ledge located intermediate the length of the pin, a contact member having a central opening, said contact member located over said pin abutting said contact ledge, said contact member being a generally winged shaped member having a constant width and including a base abutting said ledge, said contact base having a width corresponding essentially to the width of the ledge, said pin and central opening having a width substantially less than said base, said contact member being symmetrically formed to the opposite sides of said base, said contact member including connections to inclined connection portions extending outwardly and laterally from said base and terminating in outer contact portions, said contact portions extending outwardly from said connection portions in substantially parallel relation to said base, and a clamp member telescoped over said pin in abutting relation to said base and having an outer peripheral clamping portion aligned with the outer portion of said base and thereby fixedly clamping the outer portion of said base to said ledge and restricting deflection of the contact member to the connections to said inclined connection position.

11. The solenoid switch unit of claim 10 wherein contact member is an integral flat metal member and said connection portion is connected to said base and to said contact portion by essentially lateral straight line bends in the contact member and defining essentially planar surfaces in said base and said connection portion and said contact member.

12. The solenoid switch unit of claim 11 wherein said straight line bends have a minimum radius at the connection of said connection portion to said base and to said contact portion.

13. The solenoid apparatus of claim 12 wherein said contact member is formed of a hard tempered copper having an outer plating on the contact surface.

14. A small compact solenoid switch unit for use in a vibrating and shock environment, comprising a hollow cup-shaped housing having an open end and including a coil section terminating in an inner lateral clamping wall, said housing having a substantially rectangular housing section extending outwardly of said clamping wall and said coil section and forming a rectangular chamber as an extension of said coil section, said rectangular housing section having an outer end wall, a pair of spaced power terminals secured in said end wall and projecting outwardly therefrom and having inner contacts within said rectangular housing section, a solenoid coil unit disposed in said coil section including an annular coil and an armature in said coil, a floating contact unit having a bridging contact slidably mounted in said rectangular housing section and guided by the walls of said housing for movement with respect to said inner terminal contacts, an axial pin extending through said contact to the opposite side of said contact, said pin having a flat clamp ledge having a width essentially corresponding to the width of the bridging contact and abutting the contact, a clamping member secured to the pin and engaging the contact adjacent to the outer portion of said clamp ledge to rigidly mount the contact, said pin extending from said rectangular chamber through a central opening in the clamping member into engagement with said armature, and a coil spring extending between the pin and said end wall of the rectangular housing section to resiliently urge the movable contact assembly into engagement with the armature.

* * * * *

UNITED STATES PATENT AND TRADEMARK OFFICE

CERTIFICATE OF CORRECTION

PATENT NO. : 5,021,760

DATED : June 4, 1991

INVENTOR(S) : LARRY J. KRUBSACK ET AL

It is certified that error appears in the above-identified patent and that said Letters Patent is hereby corrected as shown below:

Claim 6, Col. 12, Line 37, after "said" delete "solenoid"; Claim 6, Col. 12, Line 40, delete "intermedial" and substitute therefor -- intermediate --; after "wall" delete "," (comma); Claim 7, Col. 12, Line 45, after "," insert -- said --; Claim 7, Col. 12, Line 52, after "terminal" delete "receptacle"; Claim 9, Col. 12, Line 60, delete "hving" and substitute therefor -- having --; Claim 10, Col. 13, Line 3, delete "!garden" and substitute therefor -- garden --.

Signed and Sealed this

Thirteenth Day of April, 1993

*Attest:*

*Attesting Officer*

STEPHEN G. KUNIN

*Acting Commissioner of Patents and Trademarks*